US005132736A

United States Patent [19]

Muramatsu et al.

[11] Patent Number: 5,132,736

[45] Date of Patent: Jul. 21, 1992

[54] TRANSFER DRUM WITH DIFFERENT SUPPORT POSITION FOR RESIN SHEET

[75] Inventors: Masanori Muramatsu; Hitoshi Machino, both of Yokohama, Japan

[73] Assignee: Canon Kabushiki Kaisha, Tokyo, Japan

[21] Appl. No.: 531,453

[22] Filed: May 31, 1990

[30] Foreign Application Priority Data

May 31, 1989 [JP] Japan ..... 1-138773

[51] Int. Cl.[5] ..... G03G 15/01; G03G 15/16

[52] U.S. Cl. ..... 355/271; 355/311; 355/327

[58] Field of Search ..... 355/271, 272, 274, 275, 355/311, 326, 327, 317

[56] References Cited

U.S. PATENT DOCUMENTS 4,935,776 6/1990 Fukui ..... 355/274 X

FOREIGN PATENT DOCUMENTS 62-90674 4/1987 Japan ..... 355/274

*Primary Examiner*—Joan H. Pendegrass

*Attorney, Agent, or Firm*—Fitzpatrick, Cella, Harper & Scinto

[57] ABSTRACT

An image forming apparatus includes a rotatable recording material supporting drum for supporting a recording material by electrostatic attraction; an image forming device for forming an image on the recording material supported on the recording material supporting drum; wherein the recording material supporting drum includes a recording material supporting sheet for supporting the recording material and a supporting member for supporting the recording material supporting sheet, extending in a direction substantially perpendicular to a movement direction of the recording material supporting means, and wherein when the recording material is a resin sheet, it is supported on the recording material supporting sheet at a position outside the supporting member.

60 Claims, 11 Drawing Sheets

TRANSFER DRUM WITH DIFFERENT SUPPORT POSITION FOR RESIN SHEET

FIELD OF THE INVENTION AND RELATED ART

The present invention relates to an image forming apparatus having means for supporting a recording medium, more particularly to an image forming apparatus wherein an image on an image bearing member through an electrophotographic process or electrostatic recording process is transferred onto a recording medium supported on the recording medium supporting means in the form of a rotatable drum, for example, to provide black and white, monochromatic or multi-color or full-color image.

In an electrophotographic copying apparatus, for example, irrespective of whether it is capable of forming a black and white image, a monochromatic image or a full-color image, an image is formed on an image bearing member such as an electrophotographic photosensitive drum, and the image is transferred onto the transfer material supported on the transfer material supporting member such as a transfer drum.

Referring first to FIGS. 11-16, an example of the transfer drum 230 has ring frames 231 and 232 disposed parallel at the longitudinal opposite ends, and a connecting portion 233 for connecting the ring frames 231 and 232. The connecting portion 233 functions as a supporting beam of the transfer drum to provide the mechanical strength of the transfer drum. Around the outer periphery, a high resistivity film, that is, the transfer material supporting sheet 234 is wrapped.

As shown in FIG. 13A, when the transfer material P is of A3 size or B4 size, or when the transfer material P of A4 size is fed in the direction of its length (A4R size), the leading edge portion thereof is supported on the cut portions 234*a* (FIG. 15) of the transfer drum 230 (A side attraction). When the transfer material P of A4 or B5 size is fed in the direction of its width, the leading end portion of a first sheet is supported on the cut portion 234*a* of the transfer material supporting or carrying sheet, and a second transfer material P is supported at the diametrically opposite portion (B side attraction), so that the two transfer materials P are supported simultaneously. In order to separate from the transfer drum the transfer material attracted electrostatically onto the transfer drum 230 by a corona discharger, a separating device 240 is provided, as shown in FIG. 11. The separating device 240 has a separating pawl supporting member 241 extending along an axial, longitudinal or generating line direction of the transfer drum 230 and plural separation pawls 242 fixed on the supporting member 241. Adjacent to the free ends of the separating pawl 242, abutting rollers 242*a* for the separation are mounted integrally with the poles. Adjacent to the longitudinal ends of the supporting member 241, abutting rollers 245 and 246 are provided by way of supporting plates 243 and 244. The abutting rollers 245 and 246, when the separating pawl operating clutch (not shown) is operated, are contacted to the ring frames 231 and 232 of the transfer drum, and are guided by the guiding grooves 235*a*, 236*a* or 235*b* and 236*b* formed in the rings 231 and 232, by which the free ends of the separating pawls 242 are rotated downwardly in the direction normal to the transfer drum 230.

In order to permit the easy insertion of the separating pawls 242 between the transfer material carrying sheet 243 and the transfer material P attracted and supported on the transfer material carrying sheet 243, cut-away portions 237 are formed in the connecting portion 233 for connecting the rings 231 and 232. As shown in FIGS. 11 and 15, the leading edge of the transfer material carrying sheet 234 has cuts 234*a* along the cut-away portions 237 of the connecting portion 233 in the non-image-formation area of the transfer material. By doing so, the curvature of the transfer material carrying sheet 234 (hatched portion in FIG. 15) is made locally large. The transfer material carrying sheet 234 is fixed to the connecting portion 233 in this manner.

When the transfer material attracted on the A side is to be separated, a separation pawl operating clutch (not shown) is engaged in timed relation with the leading edge of the transfer material, while the attraction force of the transfer material carrying sheet 234 is being reduced by a discharger (not shown). Then, the abutting rollers 245 and 246 are contacted to the rings 231 and 232 and are guided along the grooves 235*a* and 236. The leading edge of the separating pawl 242 rotates downwardly, so that the separating outside rollers 242*a* movable together with the separating pawls 242 are abutted to the transfer sheet 234.

The outside abutting rollers 242*a* move further along the cut-away portion 237 of the connecting portion 233, so that the separating pawl 242 enters between the transfer material P and the transfer material carrying sheet 234 at the positions where the curvature of the transfer material carrying sheet 234 locally changes, by which the transfer material P is separated from the transfer material carrying sheet.

Referring to FIG. 16, when the transfer material P attracted on the B side is to be separated, inside abutting rollers 253 in the transfer drum 230 are abutted by a driving means (not shown) to the inside of the transfer material carrying sheet 234 in the direction indicated by an arrow. Simultaneously, the abutting rollers 245 and 246 are guided along the guiding grooves 235*b* and 236*b* disposed at a position diametrically opposite from the connecting portion 233, so that the outside abutting rollers 242*a* are abutted to the outside of the transfer material carrying sheet 234, by which the curvature of the transfer material carrying sheet 234 is locally changed. Then, the separating pawls 242 are inserted between the transfer material carrying sheet 234 and the transfer material P, and the transfer material P is separated from the transfer material carrying sheet 234.

As will be understood from the foregoing, in the prior art apparatus, the leading edge portion of the transfer material P is overlapped with the cut portions 234*a* of the transfer material carrying sheet 234, and the separating pawls 242 are inserted at the overlapped portion to separate the transfer material P from the transfer material carrying sheet. Because of the leading edge portion of the transfer material P is overlapped with the connecting portion 233, the attraction force is small. Particularly when the resin sheet such as OHP (overhead projector) sheet having a less flexibility is used as the transfer material P, it is sometimes separated from the transfer drum 230 when it should be carried thereon.

In order to distinguish the OHP sheet which is transparent from the plain paper, the OHP sheet has a detection strip zone which is not transparent. However, since the detection zone is narrow, and since the detection zone and the connecting portion 233 are so close to each other when the OHP sheet is carried at the A side, a jam detecting means for detecting the attraction state of the transfer material erroneously detects the connecting portion as the detecting zone.

If, in an attempt to attract the OHP sheet at the B side, the transfer drum has to have such a large size as to be capable of attracting an OHP sheet of A4 size in the longitudinal direction (A4R), that is, two A4 size sheets in the longitudinal directions, with the result of bulky apparatus.

SUMMARY OF THE INVENTION

Accordingly, it is a principal object of the present invention to provide an image forming apparatus wherein the recording medium is prevented from being released from the recording medium supporting means, irrespective of the material of the recording medium.

It is another object of the present invention to provide an image forming apparatus capable of properly detecting a transparent sheet supported on the recording medium supporting means.

It is a further object of the present invention to provide an image forming apparatus capable of effecting correct jam detection of the recording medium in accordance with the position of the leading edge of the recording medium supported, by changing the detection timing of the recording medium.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

The preferred embodiments of the present invention will be described in conjunction with the accompanying drawings.

Figure 1:
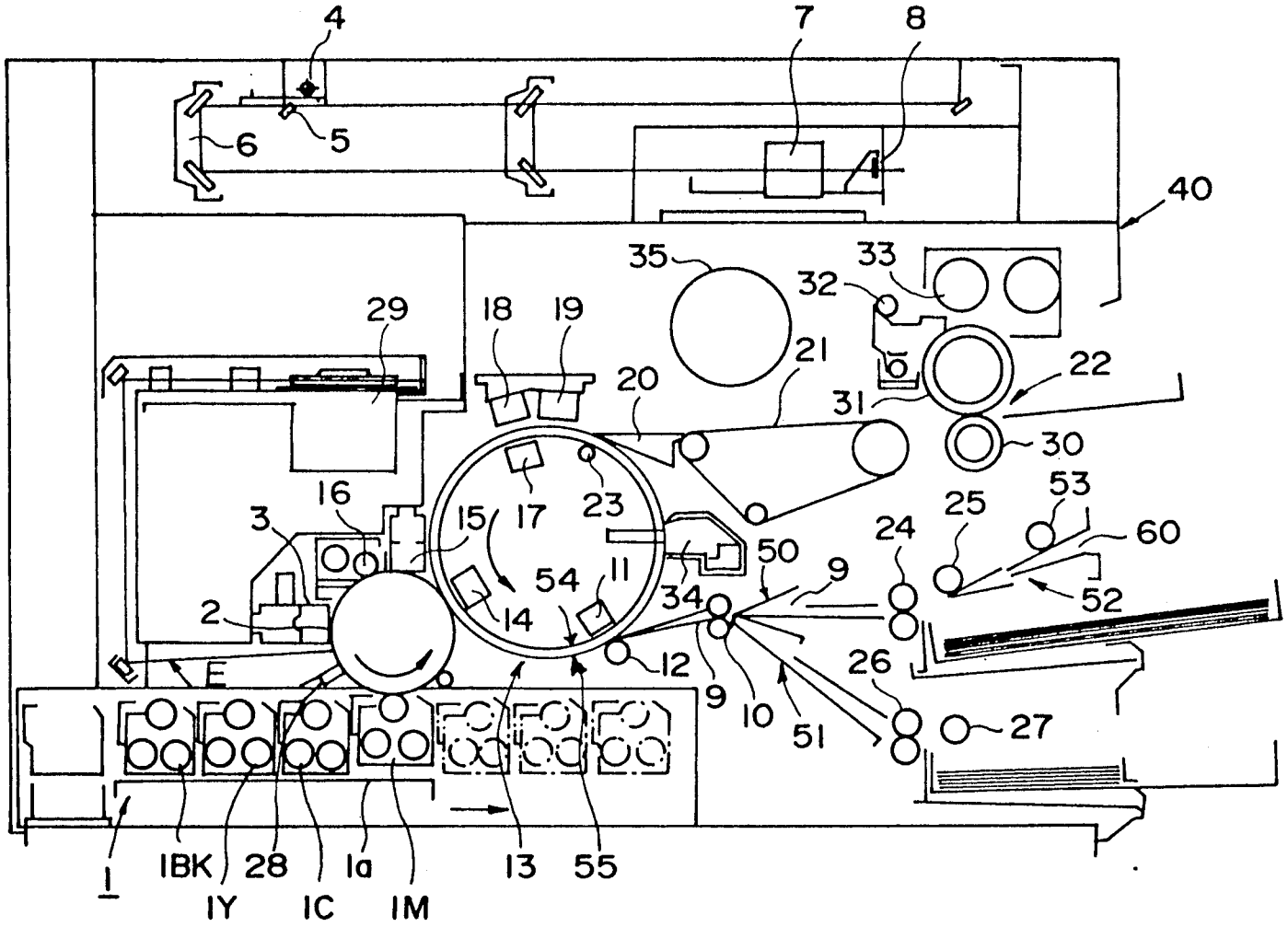
FIG. 1 shows a general arrangement of an electrophotographic color copying apparatus as an exemplary image forming apparatus according to an embodiment of the present invention.

Referring now to FIG. 1, there is shown a general arrangement of an image forming apparatus according to an embodiment of the present invention. The image forming apparatus shown in FIG. 1 is a full-color image forming apparatus of an electrophotographic recording type. The image forming apparatus will generally be described.

In FIG. 1, a recording material carrying means, that is, a transfer drum 13 is disposed substantially at the center of the main assembly 40 of the image forming apparatus. It is rotatable in the direction indicated by an arrow in FIG. 1 (clockwise direction). The transfer drum 13 has the structure similar to the transfer drum 230 described in conjunction with FIGS. 11-16, except for the portions which will be described hereinafter.

Inside the transfer drum 13, a transfer material attracting means or an attracting charger 11, an image transfer charger 14, a discharging charger 17, abutting rollers 23 for separation and a transparent type sensor 54 are disposed. Outside the transfer drum 13, there are disposed a discharging charger 18 disposed opposed to the discharging charger 17, a charger 19 and separation pawls 20 disposed opposed to the abutting rollers 23 and a sensor 55 disposed opposed to the transparent type sensor 54. Sensors 54 and 55 have a light emitting portion and a light receiving portion for receiving the light from the light emitting portion.

Furthermore, there are disposed a transfer drum cleaner 34 and transfer material attracting means, that is, an abutting roller 12 which is disposed opposed to the attracting charger 11. A photosensitive drum 2 (image bearing member) is disposed opposed to the transfer charger 14.

The abutting roller 12 is disposed adjacent to the downstream end of a sheet guide 9 having a couple of registration rollers 10 which is effective to provide the conveyance timing of the recording medium to support the recording medium at a predetermined position of the transfer drum 13. In the guide 9, transparent sensors, namely, before-registration sensors 50 and 51 are disposed to form a predetermined degree of loop of the transfer material in cooperation with the registration roller 10 and to discriminate whether the transfer material is of plain paper or an OHP sheet. The before-registration sensors 50 and 51 are constituted by the light emitting portions and the light receiving portions, similarly to the sensors 54 and 55. An upstream end of the guide 9 is forked into two direction, which are provided with a pair of feeding rollers 24 and pick-up roller 25, and a pair of feeding rollers 26 and a pick-up roller 27, respectively. Adjacent to the pick-up roller 25, there are manual feeding port 60 for permitting manual feeding of the transfer material, a feeding roller 53 for the manual feed and a sensor 52 for detecting the length of the manually fed transfer material.

Downstream of the separating pawls 20 and inside the main assembly 40 of the image forming apparatus (upper right portion in FIG. 1), an image fixing device 22 is disposed which comprises an image fixing roller 31, a pressing roller 30, oil sponge 32 and web 33. Between the fixing device 22 and the separation pawl 20, there is a transfer material conveying belt 21. Above the conveying belt 21, there is a motor 35.

Above the main assembly 40 of the image forming apparatus, there are disposed an exposure illumination lamp 4, a first mirror 5, a folding mirror 6, a lens system 7 and a color image sensor 8.

At the bottom of the main assembly 40 of the image forming apparatus, there is disposed developing means 1 of a horizontally movable type. The details of the developing means 1 will be described in detail hereinafter.

The photosensitive drum 2 is supported for rotation in the direction of an arrow in FIG. 1 (counterclockwise direction) around the photosensitive drum 2, various means for executing the image formation process are incorporated with the photosensitive drum 2, including the transfer drum 13, the transfer charger 14, the horizontally movable developing means 1, a cleaning member 16, a primary charger 3, a potential sensor 28, the discharging charger 15, the cleaning member 16, and a laser beam scanner unit 29 close to the discharging charger 15.

Now, the horizontally movable developing means 1 will be described. It comprises a movable frame 1*a* movable substantially horizontally, a magenta developing device 1M, a cyan developing device 1C, a yellow developing device 1Y and a black developing device 1BK which are supported on the movable frame 1*a*. The developing devices 1M, 1C, 1Y and 1BK are associated with juxtaposed toner hoppers at a front side in FIG. 1. The developing devices 1M, 1C, 1Y and 1BK are connected with the respective toner hoppers by flexible connecting means to permit supply of the developers at all times to the respective developing devices 1M, 1C, 1Y and 1BK even when they are horizontally moved with the movable frame 1*a*.

The description will be made as to the operation in a full-color mode in the image forming apparatus described in the foregoing.

The outer periphery of the photosensitive drum is charged substantially uniformly by the primary charger 3. Then, an original (not shown) is illuminated by the original illumination lamp 4, and is scanned. The reflected light from the original during the scanning is directed to the color image sensor 8 by way of the first mirror 5, the holding mirror 6 and the lens system 7, so that an image is formed on the color image sensor 8. The color image sensor 8 color-separates the incident light so that a magenta image signal is produced. The magenta image signal modulates a laser beam E emitted from the laser beam scanner unit 29. The photosensitive drum 2 is exposed to the laser beam E modulated in the magenta image signal, by which an electrostatic latent image is formed on the outer periphery of the photosensitive drum 2.

The electrostatic latent image formed on the photosensitive drum 2 is developed by the magenta developing device 1M already presented to and waiting at the developing position where it is faced to the outer periphery of the photosensitive drum 2.

On the other hand, the transfer material (recording medium) is fed to the transfer drum 13 with proper timing by way of the feeding guide 9 and the pair of registration rollers 10, and is wrapped around the outer periphery of the transfer drum 13 by electrostatic force provided by the attracting charger 11 and the abutting roller 12. The rotational speed of the transfer drum 13 is synchronized with the rotational speed of the transfer drum 2. The toner image formed on the outer periphery of the photosensitive drum 2 by the magenta developing device 1M is transferred onto the transfer material by the transfer charger 14.

The transfer drum 13 continues to rotate at the above-defined speed to be prepared for the transfer of the next toner image formed on the outer periphery of the photosensitive drum 2 with the next color toner (cyan in FIG. 1).

The photosensitive drum 2 is discharged by the discharging charger 14, and the residual toner remaining on the photosensitive drum 2 is removed by the cleaning member 16, and thereafter, it is substantially uniformly charged again by the primary charger 3. Then, it is exposed to the laser beam E modulated in a cyan image signal.

On the other hand, the cyan developing device 1*c* is brought to, and waits at the developing position described hereinbefore by the movement of the movable frame 1*a* in the direction of the arrow in FIG. 1, and develops the electrostatic latent image formed on the outer periphery of the photosensitive drum 2 by the laser beam E modulated in accordance with the cyan image signal, so that a cyan color toner image is formed.

The cyan toner image is transferred onto the transfer material having the magenta toner image through the above described steps.

The similar process is repeated for the yellow color component and the black color component. After the transfer material receives the four color toner images, the toner images on the transfer material are electrically discharged by the discharging chargers 17 and 18, and are recharged by the charger 19. Thereafter, the transfer material is separated from the transfer drum 13 by the separation pawls 20. The structure of the separation pawls 20 is the same as that of the separating device 240 described in conjunction with FIG. 11.

The transfer material separated from the transfer drum 13 by the separation pawls 20 is conveyed into the fixing device 22 along the transfer material conveying belt 21, and the full-color print is provided, and the series of the sequential image forming operations is completed.

Figure 2:
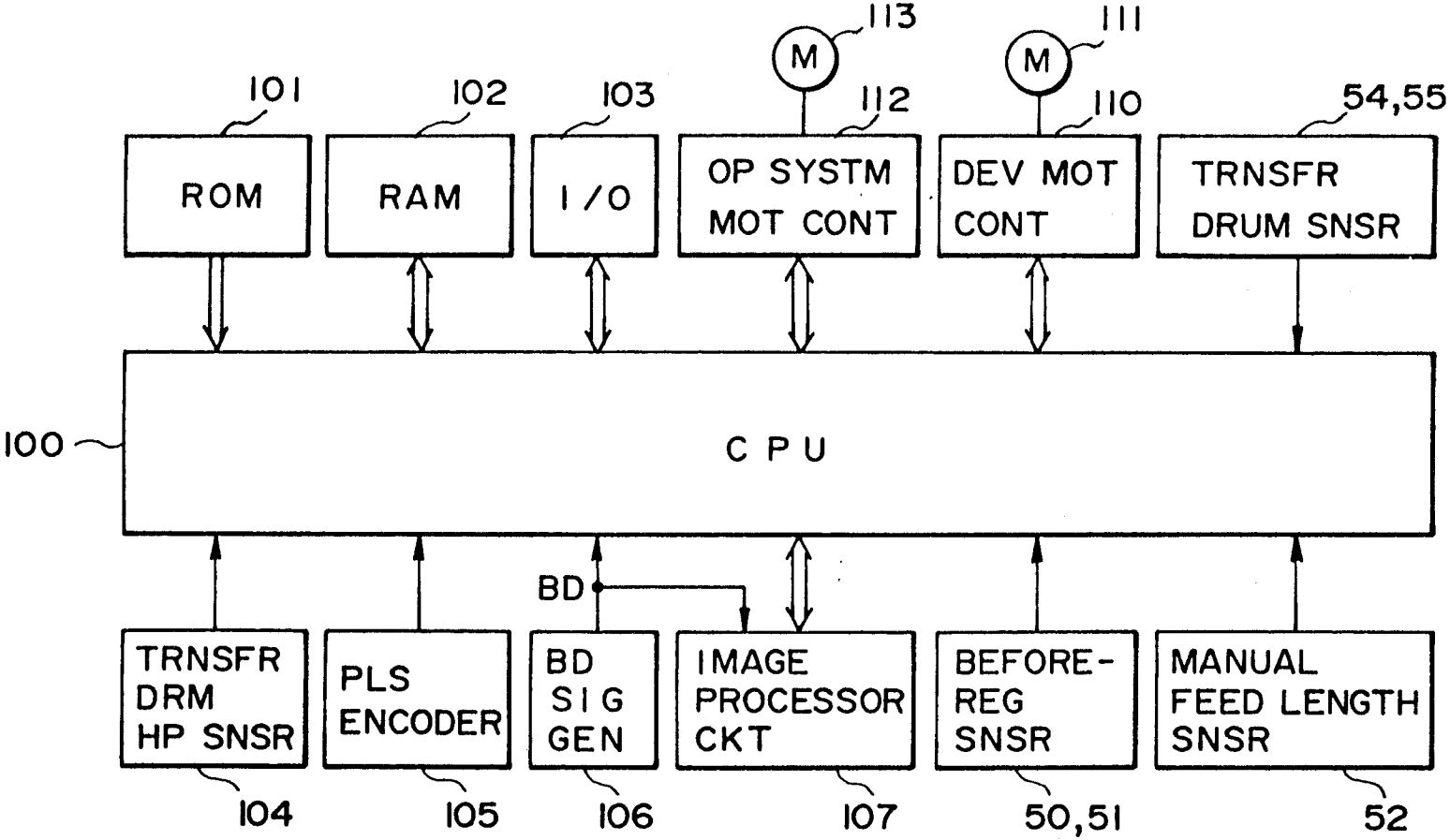
FIG. 2 is a block diagram illustrating the structure of the control system of the apparatus of FIG. 1.

FIG. 2 shows the control system of the image forming apparatus. As will be understood from this Figure, the control system includes a CPU (central processing unit) 100, ROM 101, RAM 102, I/O ports 103, a transfer drum home position sensor (transfer drum HP sensor) 104, a pulse encoder 105, beam detection signal (BD signal) generating circuit 106, and an image processing circuit 107. These elements will be further described.

The ROM 101 contains a control program and stores non-volatile data. The RAM 102 stores various data supplied to the CPU 100 from the outside thereof through the I/O ports 103 and reads various data stored in the CPU 100. The I/O ports 103 connect the CPU 100 and the external various means and devices.

Figure 6:
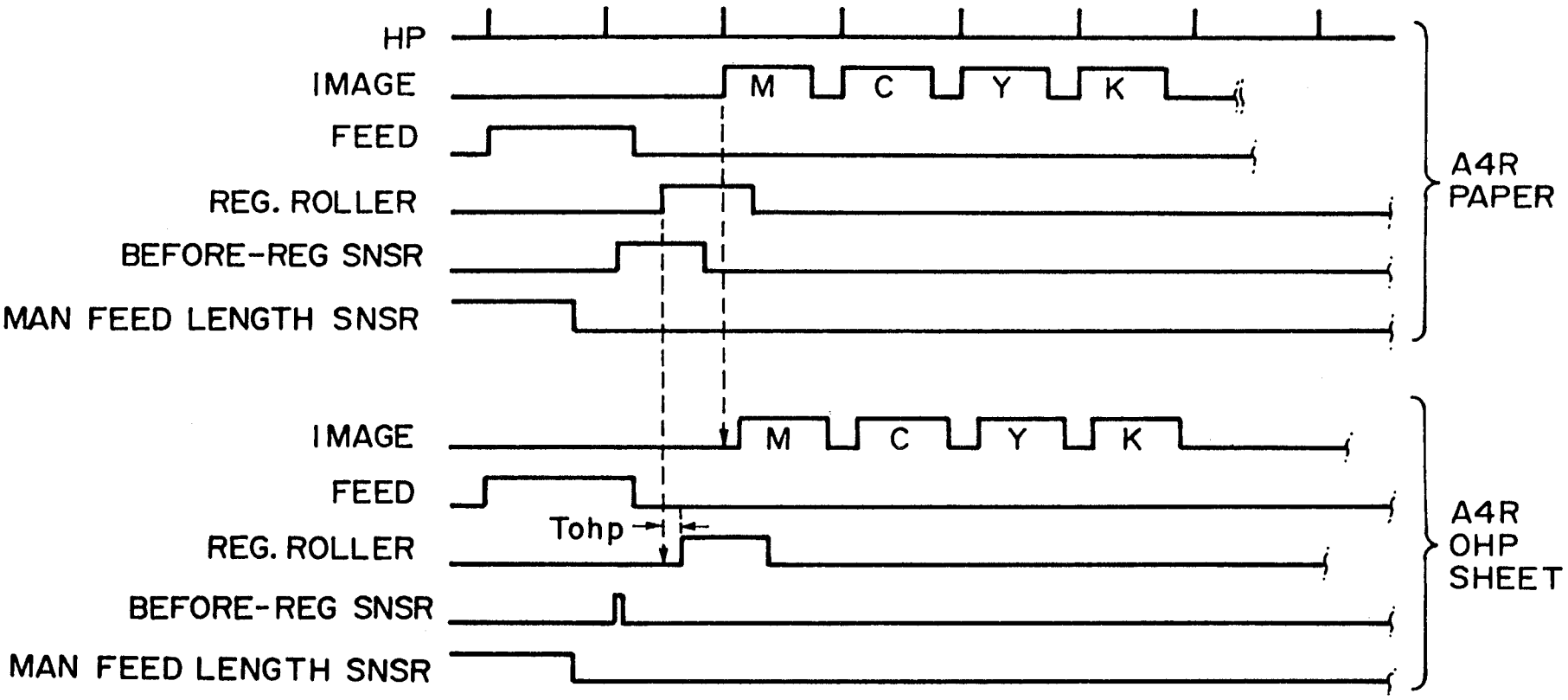
FIG. 6 is a timing chart of the operation of FIG. 1 apparatus.

The transfer drum home position sensor 104 is disposed in such a region in which it can detect one object (not shown) on the rotating transfer drum 13. The home position sensor 104 produces a predetermined pulse signal as a detection signal of a reference position on the transfer drum 13, each time the object to be detected on the rotating transfer drum 13 passes by the detecting area of the home position sensor 104. The pulse signal produced by the home position sensor 104 is as shown in FIG. 6 by reference HP.

The pulse encoder 105 detects the number of revolutions of the motor 35 for rotationally driving the transfer drum 13, and produces a predetermined pulse signal.

The beam detect signal generating circuit 106 is disposed in the laser beam scanner unit 29 to produce a horizontal synchronization signal (BD signal) which is known.

The image processing circuit effects the known shading correction to the image signal from the CCD 8, and effects the image processing such as brightness-density conversion, magnification control and image displacement or the like.

The before-registration sensors 50 and 51 are of transparent type and are disposed immediately before the registration rollers 10 with respect to the conveyance direction of the recording material, by which the discrimination is made as to whether the recording medium is plain paper or an OHP sheet.

Figure 5A:
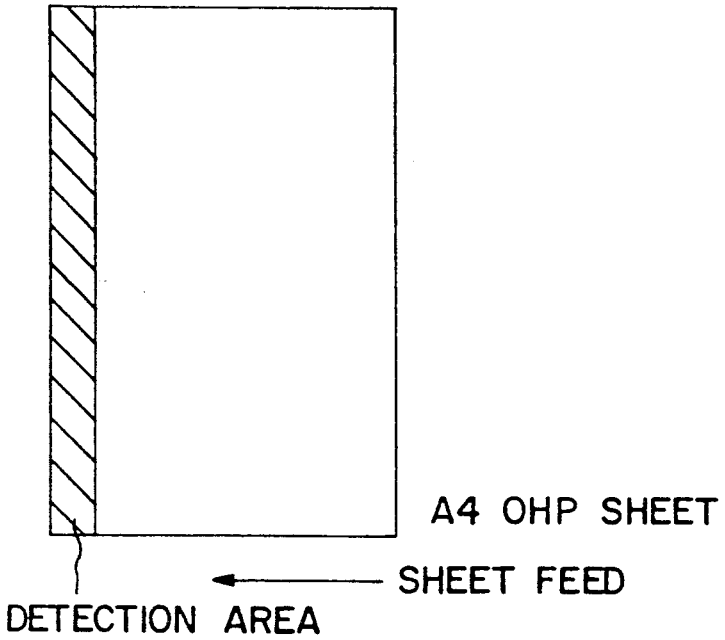
FIGS. 5(*a*) and 5(*b*) are planar views of sheets illustrating detection zone and the feeding direction of an A4 OHP sheet ends and an A4R OHP sheet, respectively.
Figure 5B:
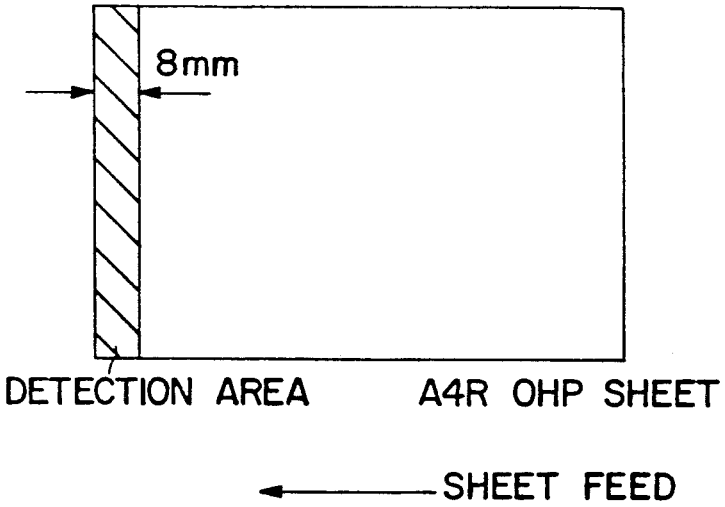

As shown in FIG. 5, the OHP sheet used in this embodiment is one of a A4 size sheet to be fed in the direction of width (FIG. 5(*a*)) and a A4 size sheet to be fed in the direction of the length thereof (FIG. 5(*b*)). Each feed position provides a detection strip zone having a width of 8 mm. This zone does not transmit the light, so that the transparent type sensor 50 and 51 can detect the leading edge of the OHP sheet. The discrimination between the OHP sheet and the plain paper is possible depending on the detection, since the plain paper does not transmit the light over the entire sheet.

A sensor 52 is effective to detect the length of the sheet manually fed through the manual feed port 60. It detects the recording material by a mechanical structure. For example, when the recording material contacts an actuator of the sensor 52, the sensor 52 produces a recording material present signal. By doing so, the determination can be made on the basis of the detection of the sensor as to whether the OHP sheet is the type shown in FIG. 5(*a*)) or that shown in FIG. 5(*b*)). The transfer drum sensors 54 and 55 detect whether the transfer drum is released from the transfer drum or not, or whether it is attracted at the correct position or not.

The sensors 54 and 55 are of a transparent type. It is a possible alternative that the sensor is provided only at the inside or outside of the transfer drum in which the light receiving portion of the sensor receives the light emitted from the light emitting portion and reflected by the object to be detected.

A controller 110 for the developing device motor controls the operation of the movable frame 1*a*. The optical system motor controller 112 controls the operation of the optical system.

Referring to FIGS. 6 (timing chart) 7 and 8 (flow charts), the description will be made as to the operation of the control system in the manual feed mode shown in FIG. 2. In the following description, the recording material manually fed is the A4 size sheet fed in the direction of the length thereof (FIG. 5(*b*)).

Figure 7:
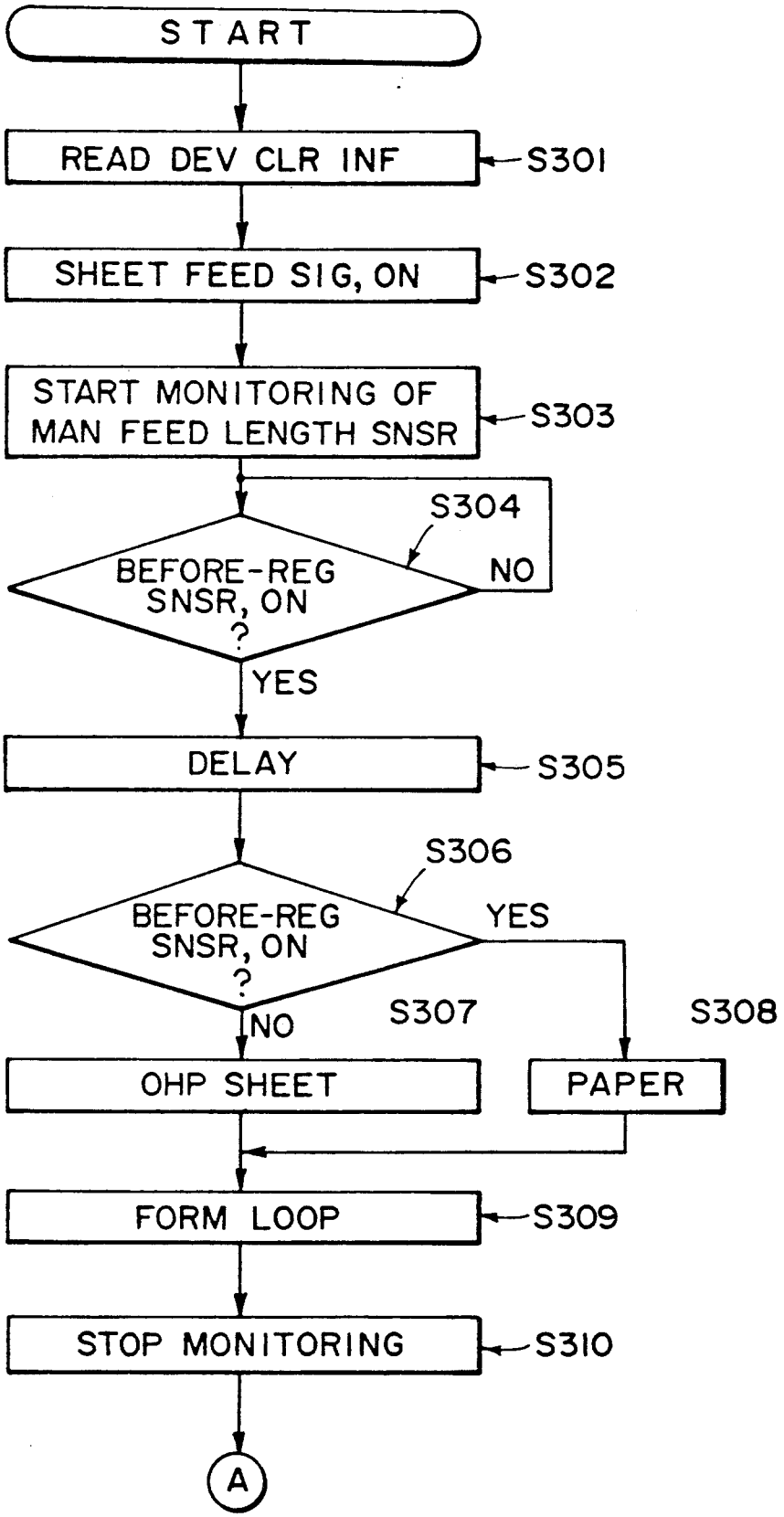
FIGS. 7 and 8 are flow charts of the sequence of the operation in the apparatus of FIG. 1.

When the operator actuates the main switch of the image forming apparatus, the CPU 100 starts its control operation. When a start key on the operation panel in the main assembly 40 of the image forming apparatus, it reads the sheet feeding station, magnification and color with which the image is to be developed, which are selected on the operation panel (S301 in FIG. 7). It is assumed that the manual feeding station and the four color mode (the image is developed with magenta, cyan, yellow and black developers are selected.

FIG. 6 shows the comparison in the timing between the plain paper and the OHP sheet of A4 size fed in the direction of the length thereof. The reference HP show outputs of the transfer drum home position sensor 104 shown in FIG. 2, which are produced once for one full rotation of the transfer drum 1.

The CPU 100 controls various I/O ports on the basis of the home position signal, the beam detection signal from the beam detection signal generating circuit 106 and a count of encoder outputs of the pulse encoder 105.

In response to the actuation of the start key, the transfer drum motor 35 is actuated, but the operation is not carried out before the home position signal is produced. After the home position is produced, a sheet feed signal FEED is rendered on (S302). By this, the transfer material set in the manual feed port 60 is fed in by the feeding roller 53.

Simultaneously therewith, the CPU 100 monitors the length detecting sensor 52 to determine the length of the manually fed sheet (S303). The distance from the length detection sensor 52 to the registration roller 10 is longer than the maximum length of the usable sheet. When the leading edge of the fed sheet reaches the registration roller 10, the sensor 52 does not detect the sheet. The fed sheet is conveyed toward the registration roller 10 by the feeding roller 24. The CPU 100 waits for the detection of the presence of the sheet by the before-registration sensors 50 and 51 to permit formation of a loop of the sheet for the purpose of correcting the oblique feeding of the sheet and to discriminate whether the sheet is plain paper or an OHP sheet (S304).

As described hereinbefore, the before-registration sensors 50 and 51 are of transparent type, and when the OHP sheet is fed, the presence of the sheet is detected only at the detecting zone formed at the leading edge of the sheet. Therefore, if the absence of the sheet is detected when the recording material passes by the before-registration sensors 50 and 51, after a properly predetermined period elapses (S305), the sheet is discriminated as being an OHP sheet (S307). If the presence of the sheet is detected, the sheet is discriminated as a plain paper sheet (S308).

Thereafter, a loop is formed by the registration roller 10, and the sheet is awaited until it is synchronized with the attraction position on the transfer drum (S309). Since the size of the manually fed sheet has already been determined, that is, since the A4 size fed in the length is determined in this embodiment, the monitoring of the length detecting sensor 109 is terminated (S310).

Figure 3:
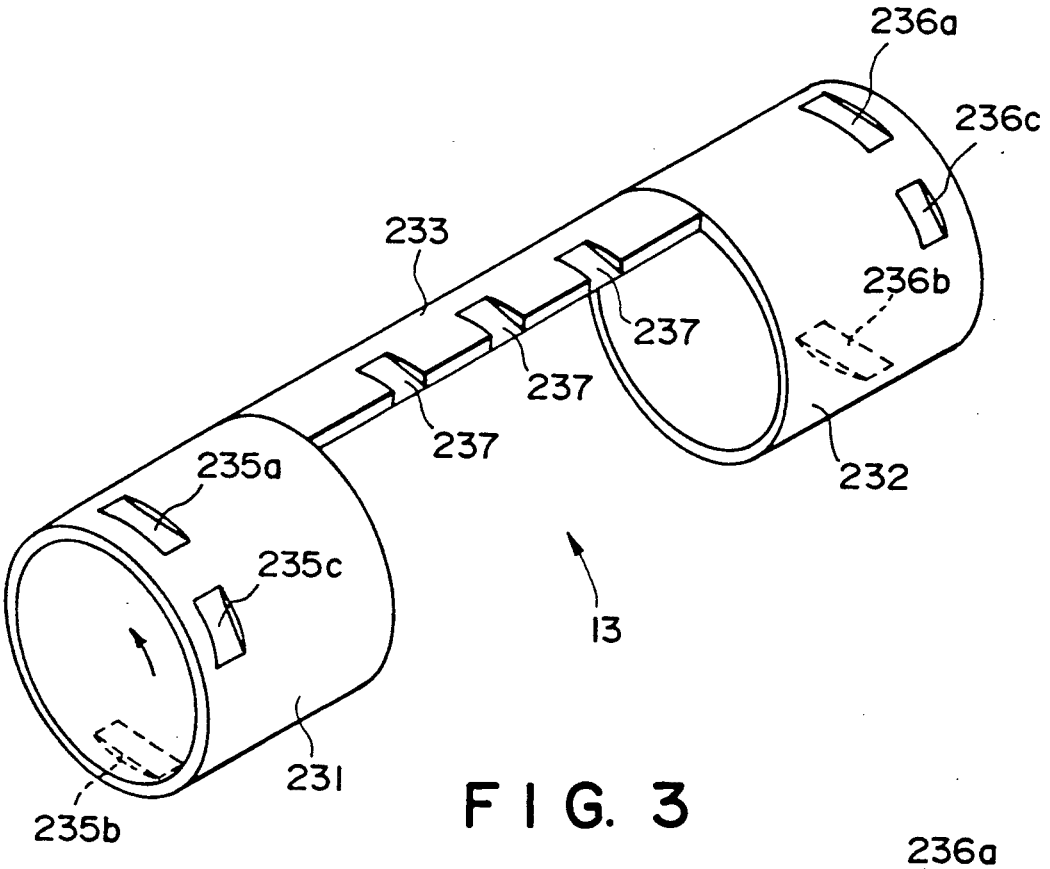
FIG. 3 is a perspective view of the entirety of the transfer drum used in the image forming apparatus according to the embodiment of the present invention.
Figure 10:
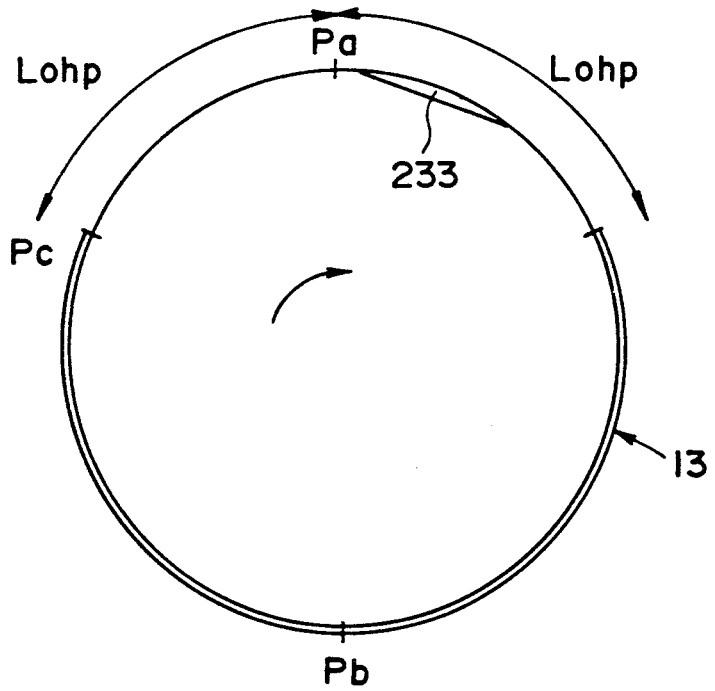
FIG. 10 illustrates the attraction of the OHP sheet in accordance with an embodiment of the present invention.
Figure 11:
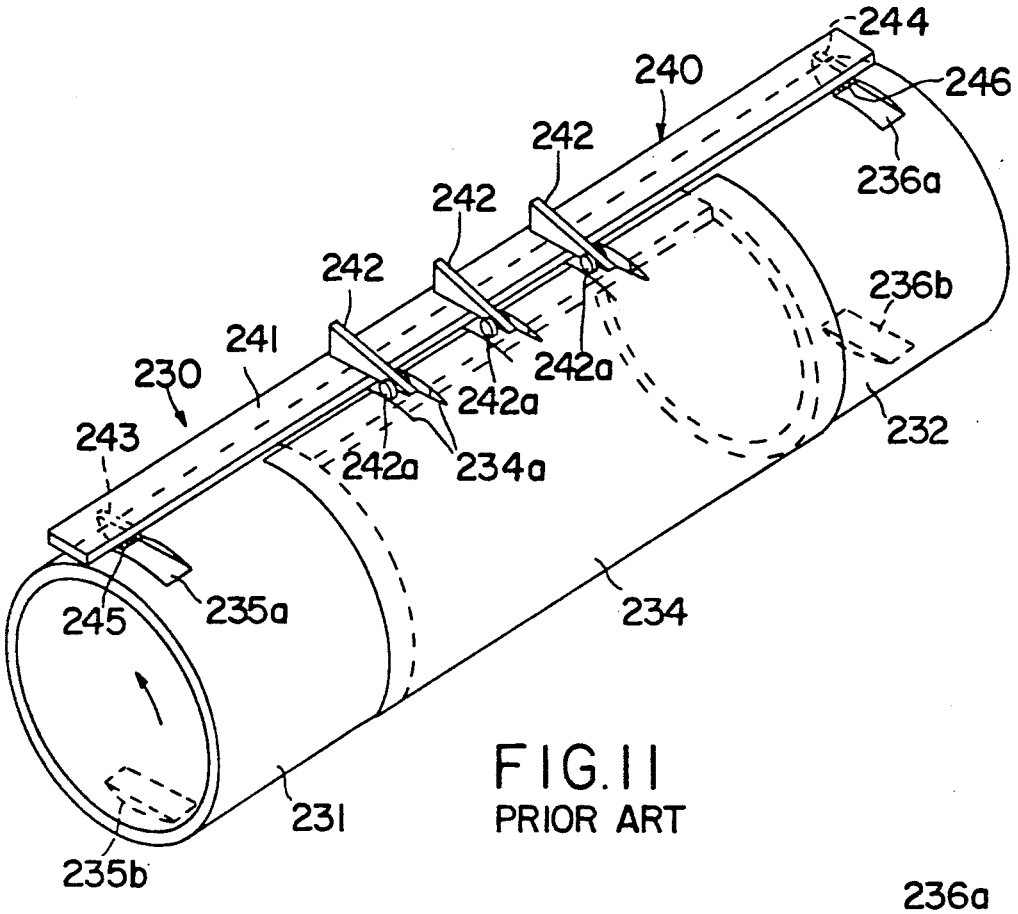
FIG. 11 PRIOR ART
FIG. 11 is a perspective view of a conventional transfer drum and a conventional separating device.
Figure 12:
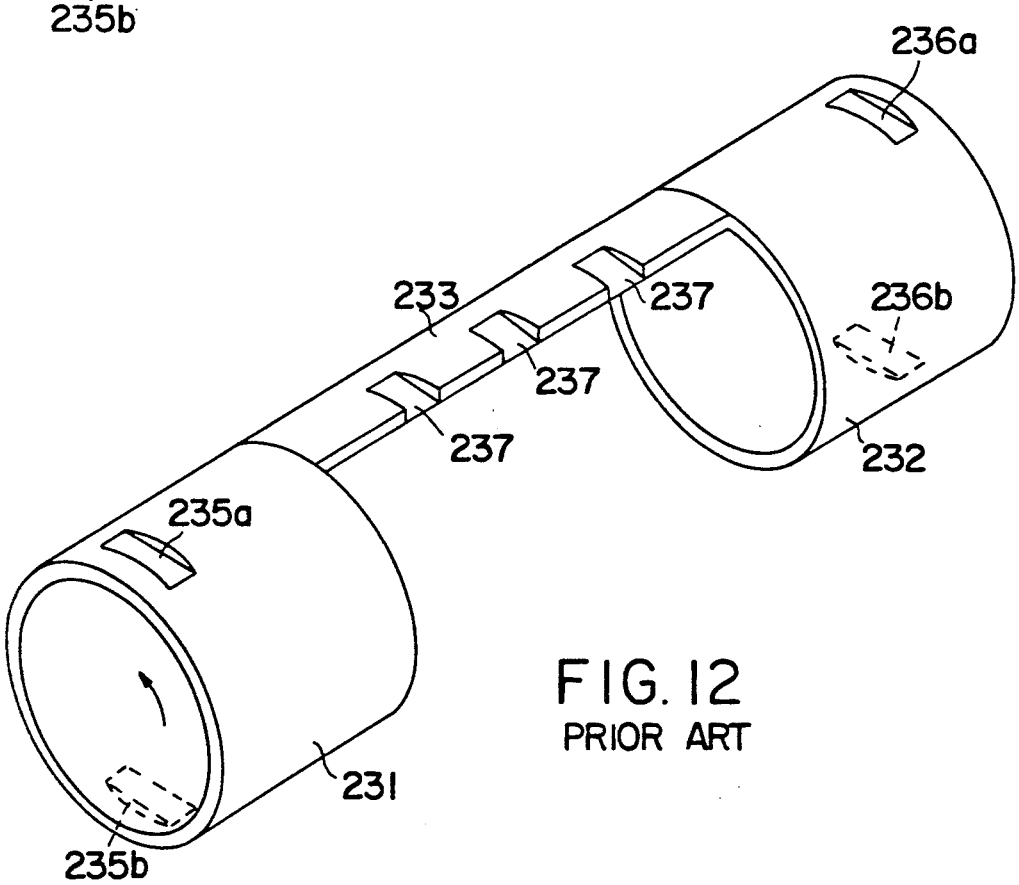
FIG. 12 PRIOR ART
FIG. 12 is a perspective view of a conventional transfer drum.
Figure 13A:
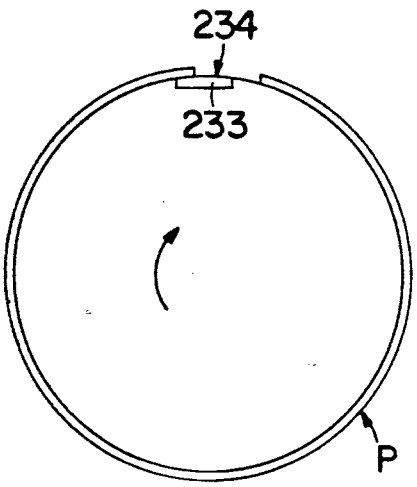
FIG. 13(a) PRIOR ART
FIGS. 13(*a*) and 13(*b*) are cross-sectional views of a conventional transfer drum illustrating the attraction state of the transfer material.
Figure 13B:
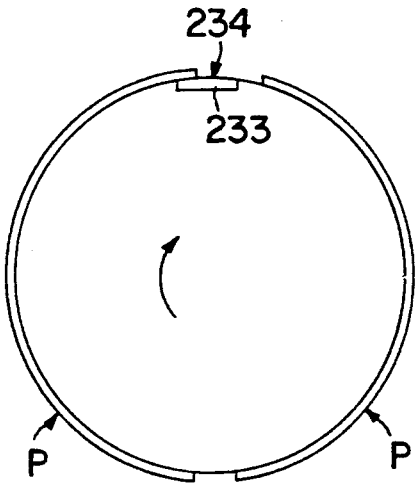
FIG. 13(b) PRIOR ART
Figure 14:
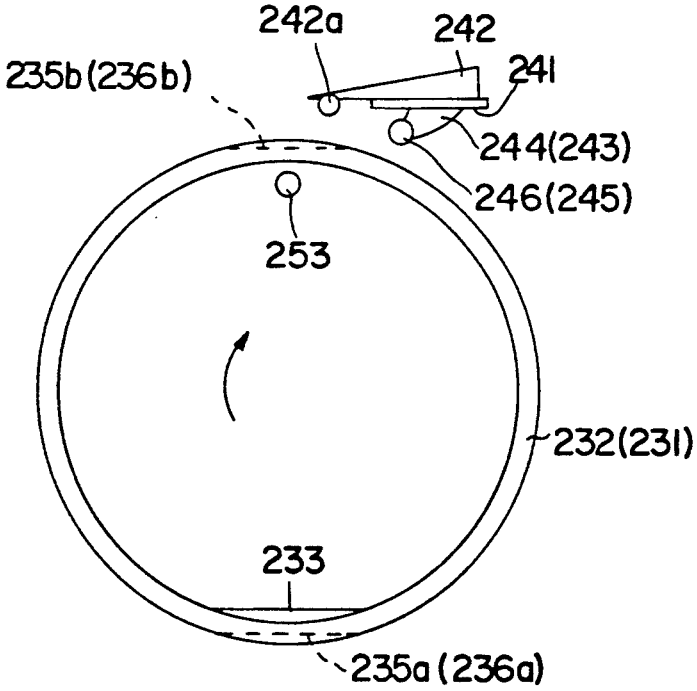
FIG. 14 PRIOR ART
FIG. 14 shows a conventional transfer drum and a conventional separating device.
Figure 15:
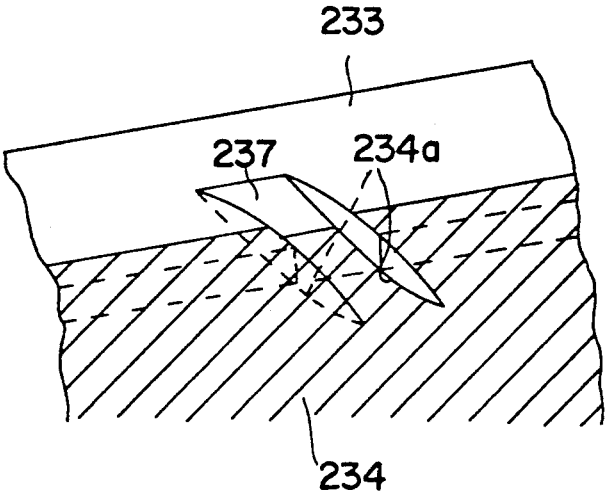
FIG. 15 PRIOR ART
FIG. 15 is a perspective view showing the cuts of the transfer material carrying sheet and the cut-away portions of the connecting portion of the transfer drum.
Figure 16:
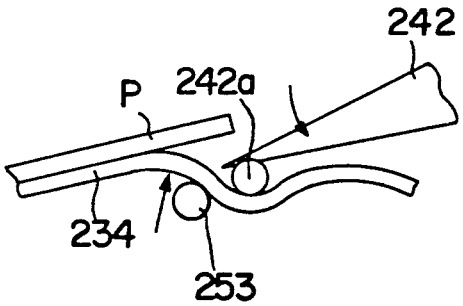
FIG. 16 PRIOR ART
FIG. 16 is a side view of the separating device.

As shown in FIG. 10, according to this embodiment, an OHP sheet attracting position is provided at a position away from the A side attracting position toward upstream by a distance Lohp in the direction of the rotation of the transfer drum. The sheet attracted at this position is subjected to the separating operation of the type for the sheet attracted at the B side position. To accomplish this, the ring 232 (231) is provided with guiding grooves 235*c* and 236*c* (FIG. 3), so that the edge of the separating pawls 242 can be moved downwardly, that is, in the direction normal to the periphery of the transfer drum upon the separating operation.

FIG. 10 shows the state in which the A4 size OHP sheet fed in the direction of the length thereof is attracted on the transfer drum 13.

In FIG. 10, the leading end position Pc attracting the OHP sheet is upstream of the leading end position Pa upon the A side attraction by a distance which is one half the difference between the circumferential length of the transfer drum 13 and the length of the A4 size sheet.

Adjacent to the position Pa, the connecting portion has the cut-away portions for reception of the separating pawls. Therefore, the attraction force for the leading edge is accordingly small, it and has been found that it is not suitable for attracting the less flexible resin sheet such as the OHP sheet.

According to this embodiment, when the sheet used is discriminated as being an OHP sheet, the sheet is attracted so that the leading edge is at the position Pc. To accomplish this, the registration roller is started (S312) after a delay from the start thereof upon the A side attraction (the leading edge at the position Pa) by the time period Tohp=Lohp/V (V is the speed of the transfer drum).

Therefore, in this embodiment, where the recording material is a resin sheet such as the OHP sheet, it is supported at a position deviated from the position where it is overlaid on the connecting portion 233 of the transfer drum on the transfer material carrying sheet 234, so that the attraction force for the resin sheet is not small, and therefore, the resin sheet is assuredly attracted on the transfer drum, by which good image forming operation is possible.

Here, necessary data is set in the image processing circuit to output the image with the leading position at the position Pc, so that the motor controller for the optical system and the developing device motor controller are controlled (S314).

Where the recording medium is the plain paper, and when it is discriminated that the sheet is A4 size sheet and fed in the length of the sheet by the manual feed detection, it is not attracted on the B side because the trailing edge of the sheet is on the transfer material carrying sheet absent position. Therefore, it is attracted on the A side. Therefore, the CPU 100, as shown in FIG. 10, controls the registration roller such that the sheet is attracted with its leading edge at the position Pa (S313). Simultaneously therewith, the necessary data are set in the image processing circuit such that the image is outputted with its leading edge at the position Pa, and the optical system motor controller and the developing device motor controller are controlled, accordingly (S315).

Thereafter, the attraction current is controlled on the basis of the detection whether the sheet is the OHP sheet or with the plain paper sheet, and the attraction operation is performed (S316). Then, it is detected by the transfer drum sensors 54 and 55 whether the transfer material is attracted at the correct position.

As described in the foregoing, the OHP sheet which is transparent is attracted at a position not overlapping with the connecting portion of the transfer drum on the transfer material carrying sheet, more particularly, with the leading edge of the recording material at the position Pc. Therefore, the detection zone at the leading edge of the OHP sheet is not overlapped with the connecting portion. Thus, the erroneous detection is avoided, that is, the absence of the sheet is not effected when the OHP sheet is actually attracted on the transfer drum, due to the overlapping of the detection zone of the OHP sheet with the connecting portion of the transfer drum.

When the transfer material is the OHP sheet, the transfer drum sensors 54 and 55, as shown in FIG. 5, effect its detecting action when the portion of the OHP sheet 5 mm away from the leading edge attracted position Pc passes through the transfer drum sensor detecting position, since the detecting zone has a width of 8 mm (S318).

The leading edge attracted position Pc on the transfer drum and the position 5 mm away therefrom are detected on the basis of the home position signal from the transfer drum home position sensor and using the beam detection signal or counting the signals from the pulse encoder. This similarly applies to the attraction leading positions Pa and Pb.

When, on the contrary, the transfer material is plain paper, the detection is effected when the position 15 mm away from the leading edge attracted position Pa passes by the transfer drum sensor detecting position (S319).

In this embodiment, the detection is effected when the above-described 5 mm position and the 15 mm position pulse by the transfer drum sensor detecting position. However, it is a possible alternative that the transfer drum sensors are operated at all times, but the output signal is only checked at the time of passage of the detecting positions.

Thus, by changing the detection times of the transfer drum sensor in accordance with the supporting position of the recording material, the connecting portion 233 of the transfer drum 13 is prevented from being detected erroneously as the recording material when it is attracted at the A side. In addition, it is possible to assuredly detect the narrow width detection zone of the OHP sheet at the C side, so that the jam detector for detecting the attracted state can correctly perform the detecting operation.

Thereafter, the unintended release or separation of the transfer material from the transfer material carrying sheet by the transfer drum sensors 54 and 55 during the developing and transferring steps for the required colors (S320). Then, the separating operation is carried out corresponding to the attracted surface (S321). The separating operation is the same as the conventional one. After the separation, the transfer material is conveyed to the image fixing device (S322), and the operation is terminated.

Figure 8:
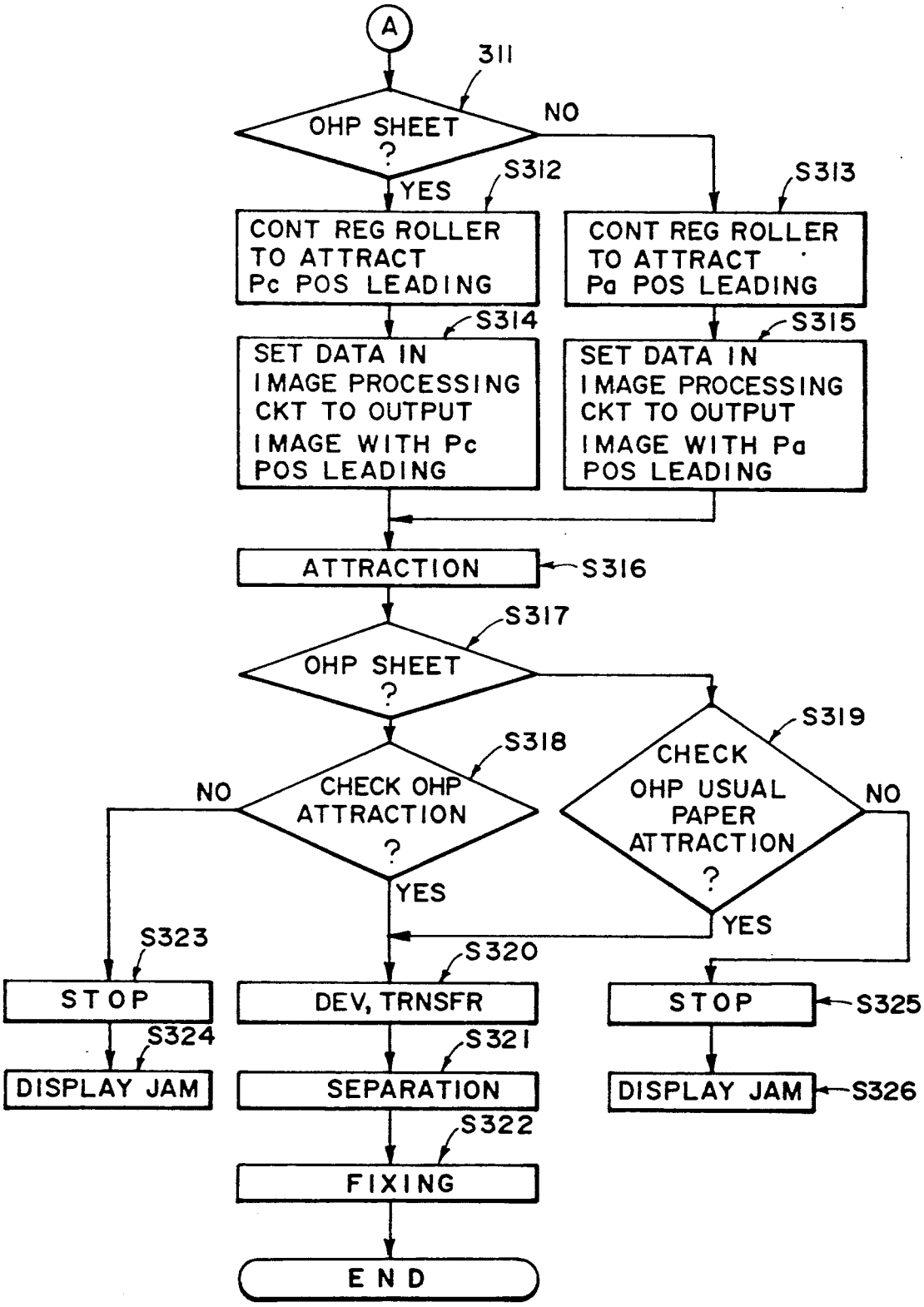
Figure 9:
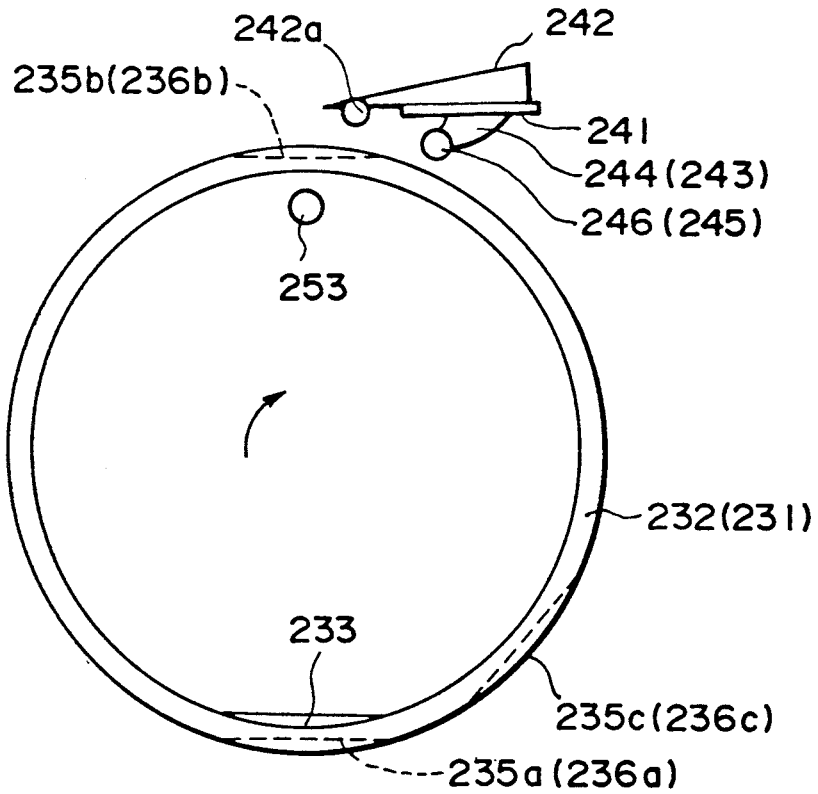
FIG. 9 is a side view of a transfer drum and a separating device usable with an image forming apparatus according to an embodiment of the present invention.

The above-described operations are described without the detection of erroneous attraction of the recording material. If erroneous attraction is discriminated, the apparatus is stopped, as shown in FIG. 8, and thereafter, the jam is displayed (S323, S324 or S325 and S326). After the jam is displayed, the apparatus is reset after the operator clears the jam.

The foregoing description has been made as to the case in which the A4 size sheet is manually fed in its longitudinal direction, but when the size of the sheet is not more than the width of the A4 size sheet, they can be attracted on the A side and on the B side, respectively.

In a flow chart of FIG. 8, when the transfer material is discriminated as the OHP sheet, it is attracted on the C side both when the A4 sheet is fed in the direction of the length thereof and is fed in the direction of its width. However, when it is fed in the direction of its width, it is possible that the sheet is attracted on the B side. In this case, it is further possible that the sheet is attracted that one of the B side and C side which can attract it earlier, by which the throughput can be increased.

Figure 4:
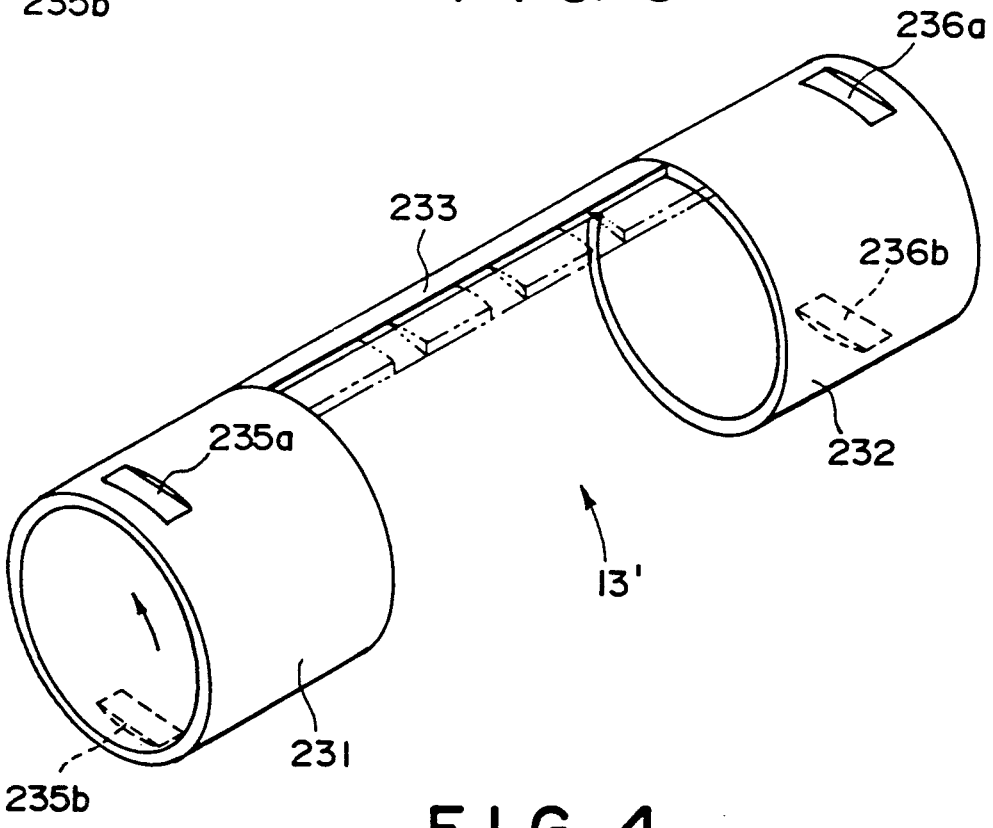
FIG. 4 is a perspective view of the entirety of the transfer material used in an image forming apparatus according to another embodiment of the present invention.

Referring to FIG. 4, an image forming apparatus according to another embodiment of the present invention will be described. FIG. 4 shows the transfer drum 13' used in this embodiment. The transfer drum 13' is different from the transfer drum shown in FIG. 3 in that the connecting portion 233 has a minimum width within the limit in which the strength of the transfer drum can be guaranteed, and the connecting portion 233 is not provided with the cut-away portion for the reception of the separating pawl.

With this structure, the space for the operation of the separation abutting rollers at the leading edge attracted position Pa close to the connecting portion, and at the point Pa, the B side separation can be carried out at the point Pb.

In the embodiment of FIG. 4, the cut of the transfer material carrying sheet is not required, so that the overlapping portion between the transfer material and the cut portion (non-transfer region of the transfer material). Therefore, when the OHP sheet is discriminated, it can be attracted with its leading edge at the point Pa. In this embodiment, the cut-away portion is not formed in the connecting portion 233, so that the distance between the connecting portion to the transfer material can be assured, by which the erroneous operation of the jam detection can be prevented.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:

rotatable recording material supporting means for supporting a recording material by electrostatic attraction;

image forming means for forming an image on the recording material supported on said recording material supporting means;

wherein said recording material supporting means includes a recording material supporting sheet for supporting the recording material and a supporting member for supporting the recording material supporting sheet, said supporting member extending in a direction substantially perpendicular to a movement direction of said recording material supporting means, and wherein when the recording material is a resin sheet, the recording material it is supported on said recording material supporting sheet at a position not overlapping the supporting member.

2. An apparatus according to claim 1, wherein said supporting member is an elongated plate.

3. An apparatus according to claim 2, wherein said supporting member is at an inside of said recording material supporting sheet in the form of a drum.

4. An apparatus according to claim 1, further comprising attracting means for attracting the recording material on said recording material support sheet.

5. An apparatus according to claim 4, wherein an attraction force is different depending on whether the recording material overlaps said supporting member or whether the recording material does not overlap said supporting member.

6. An apparatus according to claim 1, wherein the resin sheet is an overhead projector film.

7. An image forming apparatus, comprising:

rotatable recording material supporting means for supporting a recording material by electrostatic attraction;

image forming means for forming an image on the recording material supported on said recording material supporting means;

wherein said recording material supporting means includes a recording material supporting sheet for supporting the recording material and a supporting member for supporting the recording material supporting sheet, said supporting member extending in a direction substantially perpendicular to a movement direction of said recording material supporting means, and wherein when a first recording material is supported, the first recording material is supported at a position overlapping said supporting member on the recording material supporting sheet, and wherein when a second material made of material different from that of the first recording material is support, the second recording material is supported on the recording material supporting sheet at a position not overlapping said supporting member.

8. An apparatus according to claim 7, wherein the second recording material is less flexible than the first recording material.

9. An apparatus according to claim 8, wherein the first recording material is made of paper, and the second recording material is made of resin.

10. An apparatus according to claim 9, wherein the resin sheet is an overhead projector film.

11. An apparatus according to claim 7, wherein said supporting member is an elongated plate.

12. An apparatus according to claim 11, wherein said supporting member is at an inside of said recording material supporting sheet in the form of a drum.

13. An apparatus according to claim 7, wherein said recording material supporting means has rings at its opposite longitudinal ends, and wherein said recording material supporting sheet is stretched around the outer peripheries of the rings.

14. An apparatus according to claim 13, wherein said supporting member is a connecting portion for connecting the rings.

15. An apparatus according to claim 7, further comprising discriminating means for discriminating the material type of the recording material, wherein the position where the recording material is supported on said recording material supporting sheet is changed in accordance with an output of said discriminating means.

16. An apparatus according to claim 7, wherein the second recording material is supported on said recording material supporting sheet at a position upstream of a position where the first recording material is supported, with respect to a movement direction of said recording material supporting means.

17. An apparatus according to claim 7, further comprising attracting means for attracting the recording material on said recording material supporting end.

18. An apparatus according to claim 17, wherein an attraction force is different depending on whether the recording material overlaps said supporting member or whether the recording material does not overlap said supporting member.

19. An apparatus according to claim 7, further comprising separating means for separating the recording material supported on said recording material supporting means, wherein said recording material supporting means has a guiding portion for guiding said separating means.

20. An apparatus according to claim 19, wherein said guiding portion is provided for each of the first recording material and the second recording material.

21. An apparatus according to claim 7, wherein said image forming means forms plural color images on the recording material supported on said recording material supporting means.

22. An apparatus according to claim 21, wherein said image forming means forms the plural color images on the same recording material when said recording material supporting means supporting the recording material rotates through plural turns.

23. An apparatus according to claim 22, further comprising fixing means for fixing the images on the recording material, wherein the plural images are mixedly fixed by said fixing means into a full-color image.

24. An image forming apparatus, comprising:

rotatable recording material supporting means for supporting a recording material;

image forming means for forming an image on the recording material supported on said recording material supporting means;

wherein said recording material supporting means includes a recording material supporting sheet for supporting the recording material and a supporting member for supporting the recording material supporting sheet, extending said supporting member in a direction substantially perpendicular to a movement direction of said recording material supporting means, and wherein said supporting member does not transmit light, and said recording material supporting sheet transmits light;

wherein when the recording material is a transparent sheet, a leading edge of the sheet is supported on said recording material supporting sheet at a position away from a position where it is overlapped with said supporting member.

25. An apparatus according to claim 24, wherein said recording material supporting means includes longitudinally opposite end rings, and the recording material supporting sheet is stretched around outer peripheries of the rings.

26. An apparatus according to claim 25, wherein the supporting member connects the rings.

27. An apparatus according to claim 24, wherein the transparent sheet has a detection zone at its leading edge portion with respect to movement direction of the sheet for permitting detection that it is a transparent type sheet.

28. An apparatus according to claim 27, wherein said detection zone is not transparent.

29. An apparatus according to claim 24, further comprising detecting means for detecting the recording material supported on said recording material supporting means.

30. An apparatus according to claim 29, wherein said detecting means includes a light emitting portion and a light receiving portion for receiving light from said light emitting portion.

31. An apparatus according to claim 24, wherein when the recording material is paper, its leading edge is supported at a position where it is overlapped with said supporting member on said recording material supporting sheet.

32. An apparatus according to claim 24, wherein the transparent sheet is made of resin and is supported at a position outside the overlapping position.

33. An apparatus according to claim 24, further comprising attracting means for attracting the recording material on said recording material supporting sheet.

34. An apparatus according to claim 33, wherein an attraction force is different depending on whether the recording material overlaps said supporting member or whether the recording material does not overlap said support member.

35. An apparatus according to claim 24, further comprising discriminating means for discriminating the material of the recording material, and a position where the recording material is supported on said recording material supporting sheet is changed in accordance with an output of said discriminating means.

36. An apparatus according to claim 35, wherein said discriminating means includes a light emitting portion and a light receiving portion for receiving light from said light emitting portion.

37. An image forming apparatus, comprising:

rotatable recording material supporting means for supporting a recording material;

image forming means for forming an image on the recording material supported on said recording material supporting means;

wherein said recording material supporting means includes a recording material supporting sheet for supporting the recording material, stretched in a direction of rotation of said recording material supporting means, and wherein the position where the recording material is supported on said recording material supporting means is different depending on whether the recording material is a resin sheet or whether the recording material is paper.

38. An apparatus according to claim 37, wherein the resin sheet is an overhead projector film.

39. An apparatus according to claim 37, further comprising attracting means for attracting the recording material on said recording material supporting sheet.

40. An apparatus according to any one of claims 4, 17, 33, or 39, wherein said attracting means first supports the recording material on said recording material supporting sheet.

41. An image forming apparatus, comprising:

rotatable recording material supporting means for supporting a recording material;

image forming means for forming an image on the recording material supported on said recording material supporting means;

wherein said recording material supporting means includes a recording material supporting sheet for supporting the recording material, stretched in a direction of rotation of said recording material supporting means, and wherein said recording material supporting means is capable of supporting a leading edge of the recording material at different positions on said recording material supporting sheet;

detecting means for detecting at a detecting position whether the recording material is supported on said recording material supporting sheet, a distance from the detecting position to a leading edge of the recording material varying in accordance with the position where the leading edge of the recording material is supported on said recording material supporting sheet.

42. An apparatus according to claim 41, wherein said detecting means has a light emitting portion and a light receiving portion for receiving light from said light emitting portion.

43. An apparatus according to claim 41, further comprising second detecting means for detecting a predetermined position of said recording material supporting means, wherein the recording material supporting timing is determined on the basis of an output of said second detecting means.

44. An apparatus according to claim 43, wherein detecting timing of said detecting means is determined on the basis of an output of said second detecting means.

45. An apparatus according to claim 44, wherein a time period from the start of supporting of the recording material by said recording material supporting means to the start of detection of the recording material by said detecting means is different in accordance with a supporting position of a leading edge of the recording material.

46. An apparatus according to claim 41, further comprising conveying means for a conveyance passage of the recording material to temporarily stop the recording material to permit the recording material to be supported at a predetermined position on said recording material supporting means.

47. An apparatus according to claim 46, wherein a time period from the start of conveyance of the recording material by said conveying means to the start of detection of the recording material by said detecting means is different in accordance with a position where a leading edge of the recording material is supported on said recording material supporting sheet.

48. An apparatus according to claim 46, wherein said conveying means includes a registration roller.

49. An apparatus according to claim 41, wherein said detecting means detects the absence or the presence of the recording material at a position upstream of a leading edge of the recording material supported on said recording material supporting sheet with respect to a movement direction of said recording material supporting means.

50. An apparatus according to claim 41, wherein the position where the leading edge of the recording material is supported on said recording material supporting sheet is different in accordance with the material of the recording material.

51. An apparatus according to claim 41, wherein said recording material supporting means includes a supporting member for supporting said recording material supporting sheet, extended in a direction substantially perpendicular to a movement direction of said recording material supporting means, and wherein said detecting means effects its detecting operation at a position away from said supporting member.

52. An apparatus according to claim 51, wherein a distance from a leading edge of the recording material to a position wherein said detecting means detects the recording material is different depending on whether or not the leading edge of the recording material is overlapped on said supporting member.

53. An apparatus according to claim 51, wherein when the recording material is composed of paper, the leading edge thereof is supported at the overlapping position, and when the recording material is composed of transparent material it is supported outside the overlapping position.

54. An apparatus according to claim 53, wherein the transparent material is composed of resin material.

55. An apparatus according to claim 53, wherein the transparent material has a detection zone at its leading edge portion with respect to movement direction of the sheet for permitting detection that it is a transparent type sheet.

56. An apparatus according to claim 55, wherein said detection zone is not transparent.

57. An apparatus according to any one of claim 52, 53, 55, or 56, wherein the distance is smaller when the leading edge of the recording material is supported at the overlapping position than when the leading edge of the recording material is not supported at the overlapping position.

58. An apparatus according to any one of claim 1, 24, 37, or 41, wherein said image forming means forms plural color images on the recording material supported by said recording material supporting means.

59. An apparatus according to claim 58, wherein said image forming means forms the plural color images on the same recording material when said recording material supporting means supporting the recording material rotates trough plural turns.

60. An apparatus according to any one of claims 1, 7, 24, 37, or 41, wherein said image forming means includes an image bearing member and image transfer means for transferring an image from the image bearing member to the recording material supported on said recording material supporting means.

* * * * *

UNITED STATES PATENT AND TRADEMARK OFFICE

CERTIFICATE OF CORRECTION

PATENT NO. : 5,132,736

DATED : July 21, 1992

INVENTOR(S) : MURAMATSU, et al.

It is certified that error appears in the above-identified patent and that said Letters Patent is hereby corrected as shown below:

COLUMN 3

Line 50, "ends" should be deleted.

COLUMN 11

Line 52, "it" should be deleted.
Line 63, "support" should read --supporting--.

COLUMN 12

Line 23, "support," should read --supported,--.
Line 51, "of the recording material" should be deleted.
Line 63, "supporting end." should read --supporting sheet.--

COLUMN 13

Line 33, "extending said supporting member" should read --said supporting member extending--.
Line 46, "the" should read --said--.

UNITED STATES PATENT AND TRADEMARK OFFICE

CERTIFICATE OF CORRECTION

PATENT NO. : 5,132,736

DATED : July 21, 1992

INVENTOR(S) : MURAMATSU, et al.

It is certified that error appears in the above-identified patent and that said Letters Patent is hereby corrected as shown below:

COLUMN 14

Line 13, "support member." should read --supporting member.--

Line 16, "terial" should read --terial type-- and "and a" should read --wherein the--.

Signed and Sealed this

Fifth Day of October, 1993

Bruce Lehman

*Attest:*

BRUCE LEHMAN

*Attesting Officer*

*Commissioner of Patents and Trademarks*